US010096880B2

(12) United States Patent
Zhu et al.

(10) Patent No.: US 10,096,880 B2
(45) Date of Patent: Oct. 9, 2018

(54) WAVEGUIDE COMPRISING FIRST AND SECOND COMPONENTS ATTACHABLE TOGETHER USING AN EXTRUDING LIP AND AN INTRUDING GROOVE

(71) Applicant: Duke University, Durham, NC (US)

(72) Inventors: Ruoyu Zhu, Durham, NC (US); Daniel Marks, Durham, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 15/255,091

(22) Filed: Sep. 1, 2016

(65) Prior Publication Data

US 2017/0062895 A1 Mar. 2, 2017

Related U.S. Application Data

(60) Provisional application No. 62/212,786, filed on Sep. 1, 2015.

(51) Int. Cl.
*H01P 3/12* (2006.01)
*H01P 11/00* (2006.01)

(52) U.S. Cl.
CPC ..... *H01P 3/12* (2013.01); *H01P 11/002* (2013.01)

(58) Field of Classification Search
CPC ..... H01P 3/12; H01P 11/001; H01P 11/002
USPC ..... 333/239
See application file for complete search history.

(56) References Cited

U.S. PATENT DOCUMENTS 2,381,367 A * 8/1945 Quayle ..... H01P 3/14 138/128
3,157,847 A * 11/1964 Williams ..... H01P 3/12 29/600
4,020,875 A * 5/1977 Akiba ..... H01P 3/12 138/128
5,380,386 A * 1/1995 Oldham et al. ..... H01P 11/00 156/150
6,560,850 B2 * 5/2003 St John et al. ..... H01P 1/213 156/292
2006/0214751 A1 * 9/2006 Leadley-Brown et al. ..... H01P 1/042 333/254
2015/0295297 A1 * 10/2015 Cook et al. ..... H01P 3/122 333/239

OTHER PUBLICATIONS

M. D. Auria, S. Member, W. J. Otter, J. Hazell, B. T. W. Gillatt, C. Long-collins, and N. M. Ridler, "3-D Printed Metal-Pipe Rectangular Waveguides," IEEE Trans. Components, Packag. Manuf. Technol., vol. 5, No. 9, pp. 1339-1349, Sep. 2015.
S.-Y. Wu, C. Yang, W. Hsu, and L. Lin, "3D-printed microelectronics for integrated circuitry and passive wireless sensors," Microsystems Nanoeng., vol. 1, No. Apr. 2015 , p. 15013, Apr. 2015.
(Continued)

*Primary Examiner* — Benny Lee
(74) *Attorney, Agent, or Firm* — Olive Law Group, PLLC

(57) ABSTRACT

Rapid radio frequency (RF) microwave devices and methods are disclosed. According to an aspect, a waveguide includes a body having first and second components that are attachable together to form an interior having a surface. Further, the waveguide includes a conductive material formed on the interior surface and shaped to convey electromagnetic waves.

7 Claims, 20 Drawing Sheets

(56) References Cited

OTHER PUBLICATIONS

M. Liang, X. Yu, C. Shemelya, E. Macdonald, H. Xin, and E. Paso, "3D Printed Multilayer Microstrip Line Structure with Vertical Transition toward Integrated Systems," No. 1, pp. 5-8, Jul. 2015.
E. Macdonald, R. Salas, D. Espalin, M. Perez, E. Aguilera, D. Muse, and R. B. Wicker, "3D Printing for the Rapid Prototyping of Structural Electronics," IEEE Access, vol. 2, pp. 234-242, Mar. 2014.
E. De Rijk and A. Macor, "Monolithic Metal-Coated Plastic Components for mm-Wave Applications †," vol. 1, IEEE Sep. 2014.
Copper Mountain Technologies, "Design and Test of a 3D Printed Horn Antenna Design and Test of a 3D Printed Horn Antenna," Oct. 2015.
James P. Anderson, Raoul Ouedraogo, and David Gordon, "Fabrication of a 35 GHz Folded Waveguide TWT Circuit Using Rapid Prototype Techniques," General Atomics, MIT Lincoln Laboratory, Lexington, MA, IEEE Nov. 2014.
Jia-Chi Samuel Chieh, Brian Dick, Stuart Loui, and John D. Rockway, "Development of a Ku-Band Corrugated Conical Horn Using 3-D Print Technology," IEEE Antennas and Wireless Propagation Letters, vol. 13, Jan. 2014.
Carolina E. Collins, Robert E. Miles, John W. Digby, Geoff M. Parkhurst, Roger D. Pollard, J. Martyn Chamberlain and D. Paul Steenson, "Micro-Machined "Snap-Together" Rectangular Waveguide For Terahertz Circuits," Institute of Microwaves and Photonics, School of Electronic and Electrical Engineering, The University of Leeds, Leeds, LS2 9JT, UK, Physics Department, University Of Nottingham, Nottingham NG7 2RD, UK, Sep. 1998.

* cited by examiner

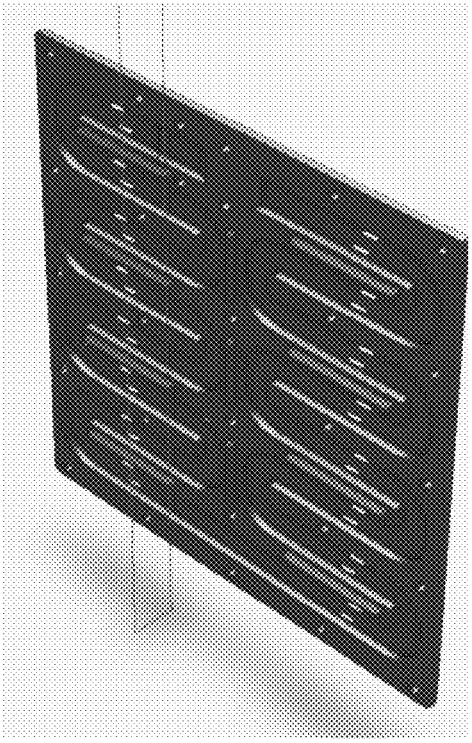
FIG. 21
FIG. 22
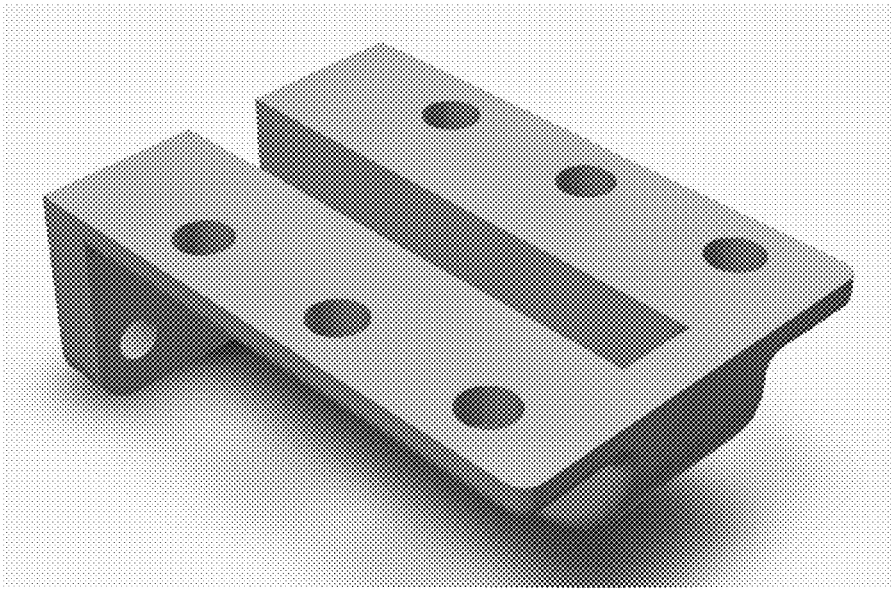

WAVEGUIDE COMPRISING FIRST AND SECOND COMPONENTS ATTACHABLE TOGETHER USING AN EXTRUDING LIP AND AN INTRUDING GROOVE

CROSS REFERENCE TO RELATED APPLICATION

This application claims priority to U.S. Provisional Patent Application No. 62/212,786, filed on Sep. 1, 2015 and titled SYSTEMS AND METHODS FOR RAPID RF MICROWAVE DEVICES, the disclosure of which is incorporated herein by reference in its entirety.

GOVERNMENT RIGHTS NOTICE

This invention was made with government support under Federal Grant No. HSHQDC-12-C-00049 awarded by the Department of Homeland Security. The government has certain rights to this invention.

TECHNICAL FIELD

The presently disclosed subject matter relates to waveguide components. Particularly, the presently disclosed subject matter relates to rapid radio frequency (RF) waveguide components.

BACKGROUND

Traditional waveguide components are made of bulk metal materials of low resistivity such as brass, copper, silver, and aluminum. Waveguide structures are fabricated by bending, welding, brazing, and soldering stock waveguide tubes onto flanges. Due to the increasing interest in development in the millimeter wavelength range of the electromagnetic spectrum, it is desirable to fabricate waveguides in much smaller sizes and into more complicated, integrated structures. The downscaling of the waveguides challenges current fabrications techniques. Currently, high precision waveguides are being produced with micro-fabrication techniques, such as dip-brazing, electronic discharge machining, computerized numerically controlled machining, and stereo-lithography. All these techniques are complicated and require expensive equipment and even a clean room, which results in high costs and long fabrication time. Accordingly, there is a continuing need for improved techniques for producing waveguide components and structures.

SUMMARY OF THE INVENTION

The present disclosure provides systems and methods for rapid prototyping of microwave and RF devices such as filters, couplers, and more complicated structures such as integrated networks that comprise multiple components. In accordance with embodiments, low cost precision waveguide components can be made from light weight non-metal material such as ABS plastic. For plastic parts to be able to interact with electromagnetic radiation, an electro-deposition technique such as electroplating may be used to metalize surfaces and parts so that it bears desired electric and magnetic properties. In particular, by manufacturing the part as upper and lower halves that are joined, rather than as a single piece, more complicated and integrated structures may be fabricated using three-dimensional printing or plastic molding. Thus, the present disclosure can provide the advantage of low cost, light weight, fast prototyping, and the ability to easily make customized components.

According to an aspect, a waveguide includes a body having first and second components that are attachable together to form an interior having a surface. Further, the waveguide includes a conductive material formed on the interior surface and shaped to convey electromagnetic waves.

According to another aspect, a method includes providing first and second components that are attachable together to form an interior having a surface. The method also includes forming conductive material on at least a substantial portion of the interior. Further, the method includes attaching the first and second components together to form the interior.

BRIEF DESCRIPTION OF THE SEVERAL VIEWS OF THE DRAWINGS

The foregoing aspects and other features of the present subject matter are explained in the following description, taken in connection with the accompanying drawings, wherein:

FIG. 21 is a side perspective view of an example spiral waveguide component in accordance with embodiments of the present disclosure.

FIG. 22 is a top perspective view of an example waveguide component in accordance with embodiments of the present disclosure.

DETAILED DESCRIPTION OF THE INVENTION

For the purposes of promoting an understanding of the principles of the present disclosure, reference will now be made to various embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Unless otherwise defined, all technical terms used herein have the same meaning as commonly understood by one of ordinary skill in the art to which this disclosure belongs.

The present disclosure relates to rapid prototyping of microwave and RF devices such as waveguides, filters, couplers, and more complicated structures such as integrated networks having multiple components. The presently disclosed subject matter can provide components that meet the requirement of scaling down to millimeter scale features or even smaller. Further, the presently disclosed techniques can be used to reduce the time and cost required to fabricate such devices. The presently disclosed techniques can also be used to produce light weight devices.

An example advantage of the presently disclosed subject matter is that fabrication techniques of waveguides are provided that are single and integrated millimeter-wave components using digital prototyping of printed circuit boards at low frequencies. At lower frequencies, circuit boards have sufficiently low loss as to allow a signal to propagate hundreds or thousands of wavelengths down a dielectric transmission line or waveguide. As frequencies approach 100 GHz, fabrication technique based on bulk dielectric transmission lines or waveguides become sufficiently lossy so that significant amounts of power are lost even through 20 centimeters of propagation or less. Techniques disclosed herein provide for prototyping and manufacturing integrated modules including waveguides, couplers, and antennas that are air-filled and therefore not subject to the same losses as bulk dielectric components. This may not be easily achieved by waveguides that are not split into upper and lower halves as machining or electroplating features deep inside structures becomes increasingly difficult the further into a structure the features are located. In contrast, the techniques disclosed herein enable these air-filled structures to be assembled as layers.

Figure 1:
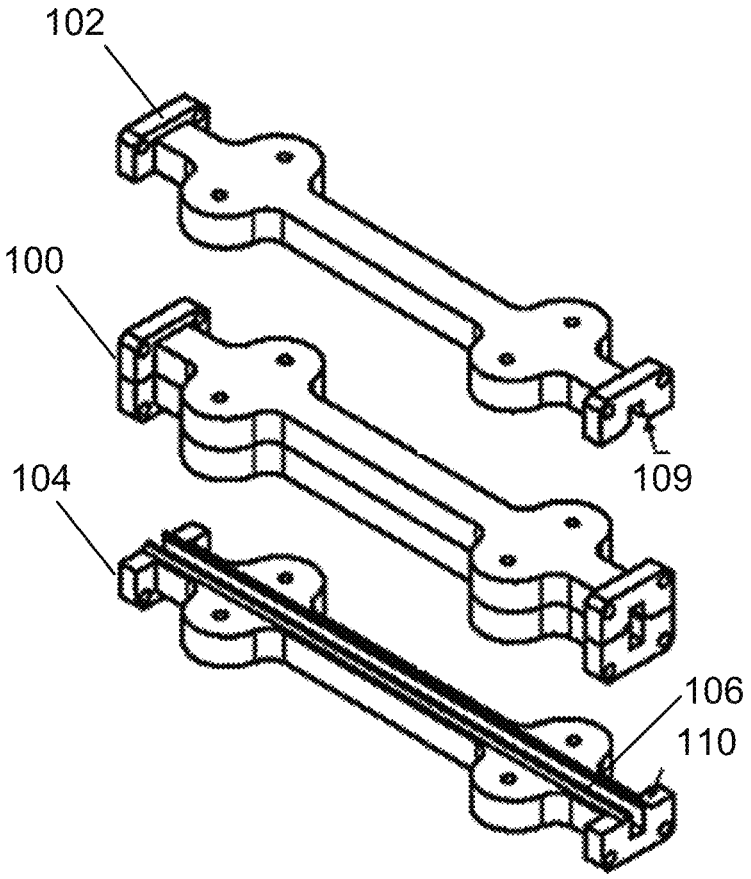
FIG. 1 depicts top perspective views of an example waveguide in accordance with embodiments of the present disclosure.

Computer aided design may be used for allowing the modeling of various types of microwave components, such as waveguide sections, directional couplers, horn antennas, and even more complicated waveguide elements such as waveguide filters. FIG. 1 depicts a drawing of a K-band TE10 waveguide section 100 made in split block. The section 100 includes two components 102 and 104 that are attachable together to form an interior 106 having a surface. Component 102 is the top half of the waveguide, and component 104 is the bottom half of the waveguide. The split block design can be used because it is easier for the key part, i.e. the inside walls or surface 104 of the WR-42 channel, to be electroplated. The electroplating may form any suitable metal or conductive material. Due to the shape of the interior formed by components 102 and 104, the conductive material is shaped to convey electromagnetic waves. When combining the upper and lower halves of a split-block waveguide that are made of bulk metal, there is a small gap between the halves that is the major source of leakage and loss of the wave. The ability to control the loss depends on machining accurately as to minimize the size of the gap, as metal is inelastic and therefore does not deform easily to fill the gap. The leakage problem for waveguides made of plastic can be improved by employing a lip and groove design (depicted by reference numerals 109 (groove) and 110 (lip) in FIG. 1), featuring an extruding lip on one block, and an intruding groove on the other. The lip and the groove are designed to have some interference when combining, thus creating a wiping action between the two blocks. When the upper and lower halves are bolted together, the lips and groove wipe against each other, forming an air-free junction between the halves. As a result, the crack between the two blocks is less leaky. The plastic utilized can have some flexibility, and not be brittle, so that the plastic can deform slightly without cracking and adjust to the small amount of interference. Also note that the waveguide flange itself may be fabricated onto the top and bottom halves and then assembled as a single piece, thus enabling the entire part to integrate the waveguide and flanges. Screws may be used to attach the lower and upper halves, also providing a force to close the gap between the upper and lower halves. A sufficient number and placement of screws or other fasteners can be used to ensure an adequate force is applied throughout the length of the waveguide to close the gap between the upper and lower halves. Alternatively, the gap may be closed by a suitable soldering technique. As shown in FIG. 1, the waveguide can be made into two identical blocks and soldered together at the mid-gap. Alternatively, a full waveguide may be made with a lid on the top and solder between the lid and the waveguide channel.

The components 102 and 104 may be made of plastic or any other suitable material. In an example, the components 102 and 104 may be 3D printed components.

As shown in FIG. 1, the surface of the interior 106 may extend substantially in a linear direction with the body of the waveguide. Alternatively, the interior surface may be in any suitable form and include one or more curved portions, linear portions, or other suitable shapes for waveguide techniques as will be appreciated by those of skill in the art. The components 102 and 104 when formed together or along may form one or more outputs into which electromagnetic waves may enter or exit as will be understood by those of skill in the art.

Figure 2:
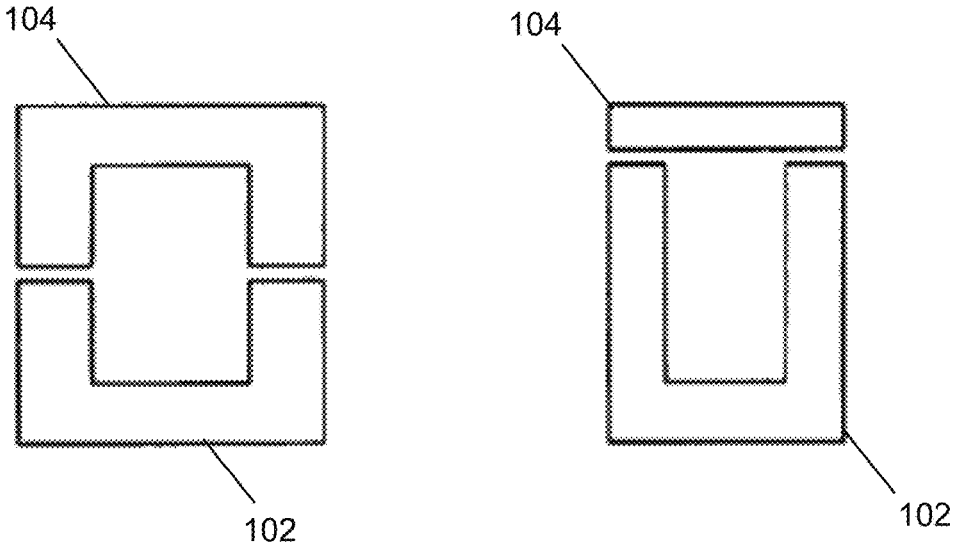
FIG. 2 are cross-sectional front views depicting a simple k-band TE10 waveguide section made in split block on the left side and an example soldering technique to combine two halves of waveguide block and close the gap in accordance with embodiments of the present disclosure.

FIG. 2 depicts drawings of a K-band waveguide assembly made from E-plane split blocks. The split blocks can form a lip and groove for attachment of the components 102 and 104 together and for reducing leakage due to the split crack.

Figure 3:
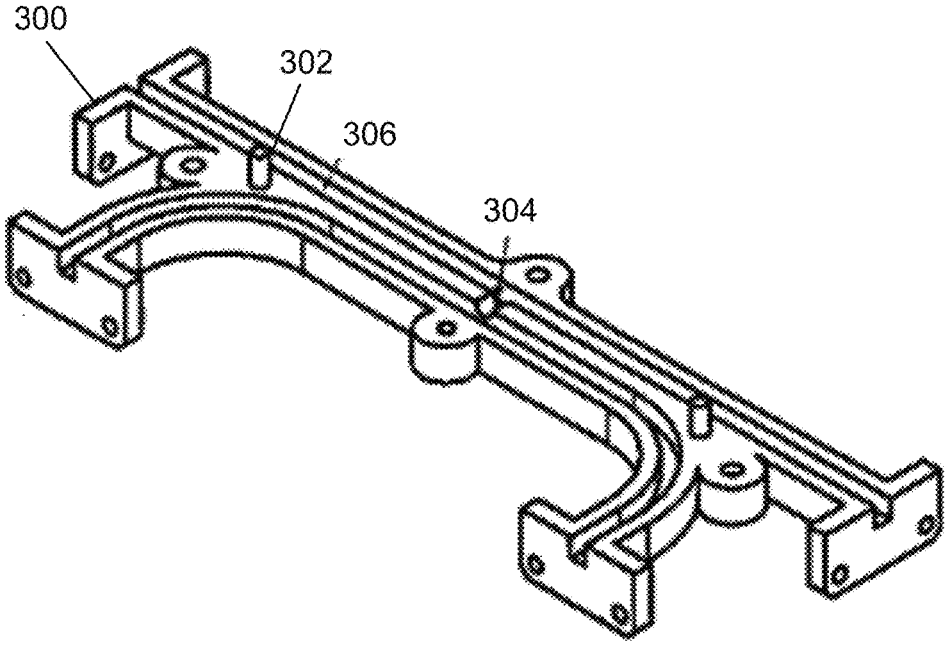
FIG. 3 is a top perspective view of a half block of a directional Bethe-hole coupler in accordance with embodiments of the present disclosure.

Now referring to FIG. 3, another example application of the presently disclosed subject matter is provided for making microwave couplers. In FIG. 3, a directional coupler may include two waveguide sections connected by a small hole through the side walls. FIG. 3 shows the bottom section 300; however, the top section may be very similar except for features such as attachment features 302. Instead, the top section may have mating attachment features for connecting to features 302 to hold the top and bottom sections together. The details and methodology of designing directional couplers, such as determining the hole diameters and wall thickness between the input channel and the output channel, may be suitably selected as will be understood by those of skill in the art. A coupler can be more complicated than a straight waveguide section, however its complication does not cause extra difficulty and cost in making a prototype in accordance with the present disclosure, as a coupler formed from two waveguides is split as easily as a single waveguide, with the coupling hole either divided between the upper and lower halves or only on the upper or lower halves. A 3D printed coupler can be made as two blocks, split from the middle E-plane that results in two identical parts. The inside walls of the channels may be electroplated with copper to confine electromagnetic waves and couple the wave from the input channel to the output channel Referring to FIG. 3, the bottom section 300 defines a coupling hole 304 for connecting two different waveguide channels as shown. One of the waveguide channels is a K-band channel 306.

Figure 4:
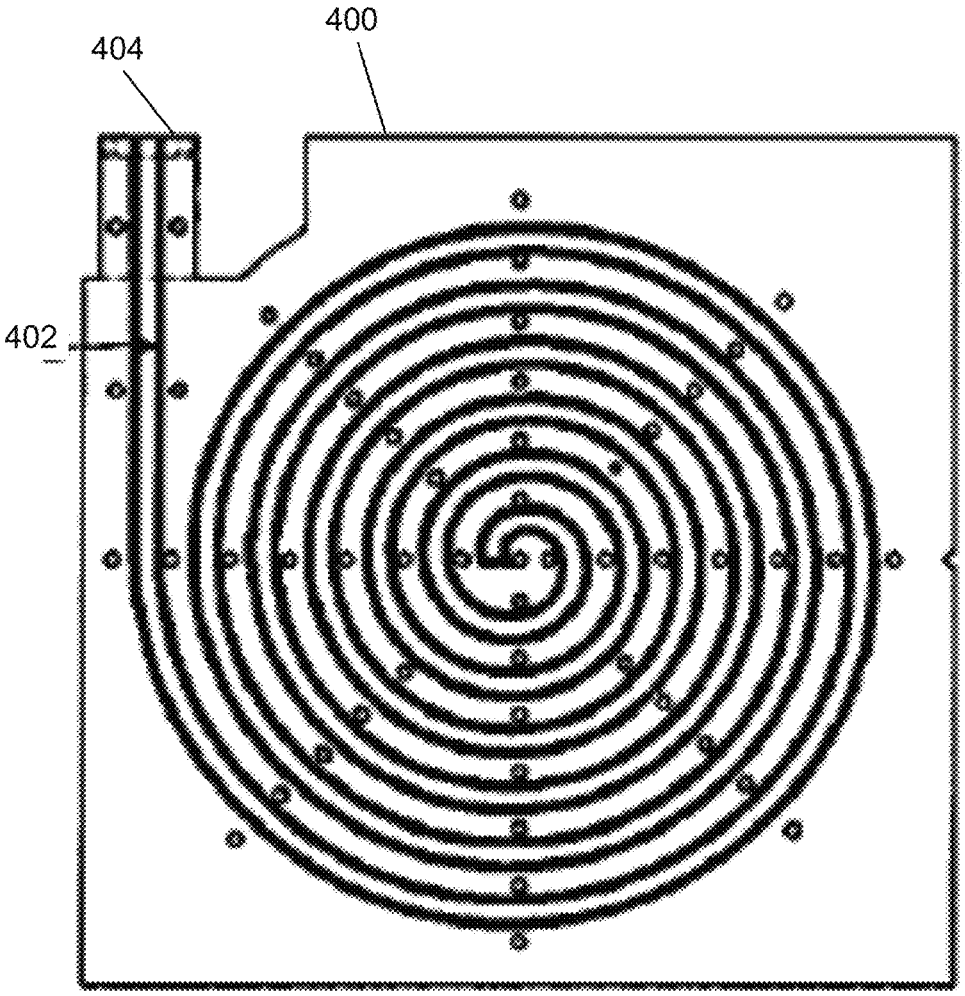
FIG. 4 is a top view of a spiral waveguide made by presently disclosed methods for k-band applications in accordance with embodiments of the present disclosure.

It is noted that 3D modeling can enable the design of waveguides catering to specific applications and requirements that can be considerably difficult to build otherwise. FIG. 4 shows an example of a single ended spiral waveguide designed for K-band. The waveguide is desired to have a long distance within a compact design. It can be used as a delay line. This includes a flange, a spiral delay line, and holes for the screws to fasten the upper and lower halves together. This particular part can be expensive to machine and therefore can be better suited to the fabrication process disclosed by the present subject matter.

FIG. 4 is a top view of a spiral waveguide made by presently disclosed methods for k-band applications in accordance with embodiments of the present disclosure. Referring to FIG. 4, the bottom part 400 of the waveguide is shown along with its interior channel 402 formed in accordance with embodiments of the present disclosure. The interior channel 402 is a spiral K-band channel Further, the waveguide includes an adaptor 404.

A closed rectangular cavity or a parallel plate waveguide can be used as guiding structures for electromagnetic waves. However, such structures are not the only one that is able to guide electromagnetic waves. A periodic structure, such as a metal grating on the surface of a dielectric slab can also guide waves. The presently disclosed subject matter can facilitate the fabricating of such waveguides because of the ability to deposit metal over dielectric parts.

Applications of the presently disclosed subject matter are not limited to guiding waves but may also be used to make artificial and synthetic media such as metamaterials. For example, a circuit including an array of split ring resonators can be made by patterning a circuit board. A split ring resonator can produce desired magnetic susceptibility, creating interesting effects such as negative permeability and permittivity. These synthetic materials may be placed within rectangular or parallel plate waveguides fabricated using the above process to modify the propagation characteristics of the waveguide. In this way, the advantage of lower loss of the waveguide is realized (as the walls of the waveguide confine the wave) while the wave can still interact with the resonant structures on a circuit board placed within the waveguide. Therefore, a hybrid structure that avails itself of the advantages of both waveguides and metamaterials may be realized.

Figure 5:
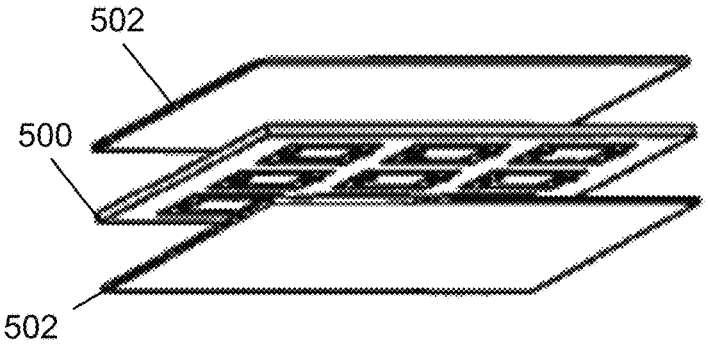
FIG. 5 is a top view of a split ring resonator circuit that can be made in accordance with methods of the present disclosure, placed in between a pair of conducting plate to customize radiation patterns in accordance with embodiments of the present disclosure.
Figure 5:
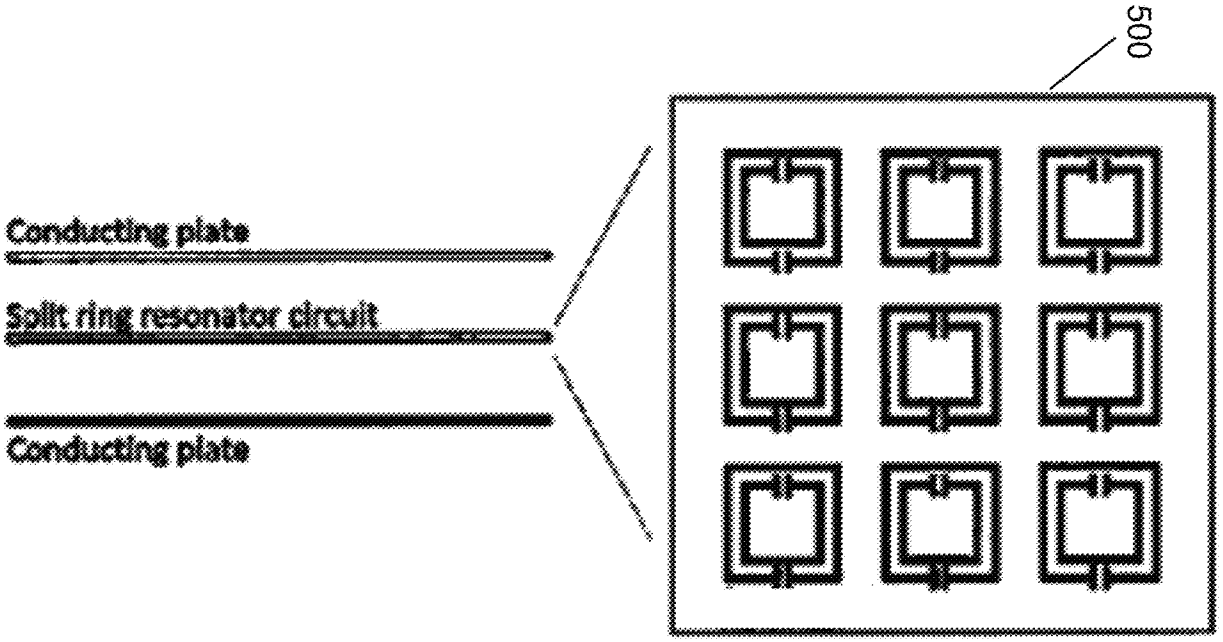

FIG. 5 depicts a split ring resonator circuit 500 that can be made in accordance with methods of the present disclosure, placed in between a pair of conducting plates 502 to customize radiation patterns in accordance with embodiments of the present disclosure.

Figure 6:
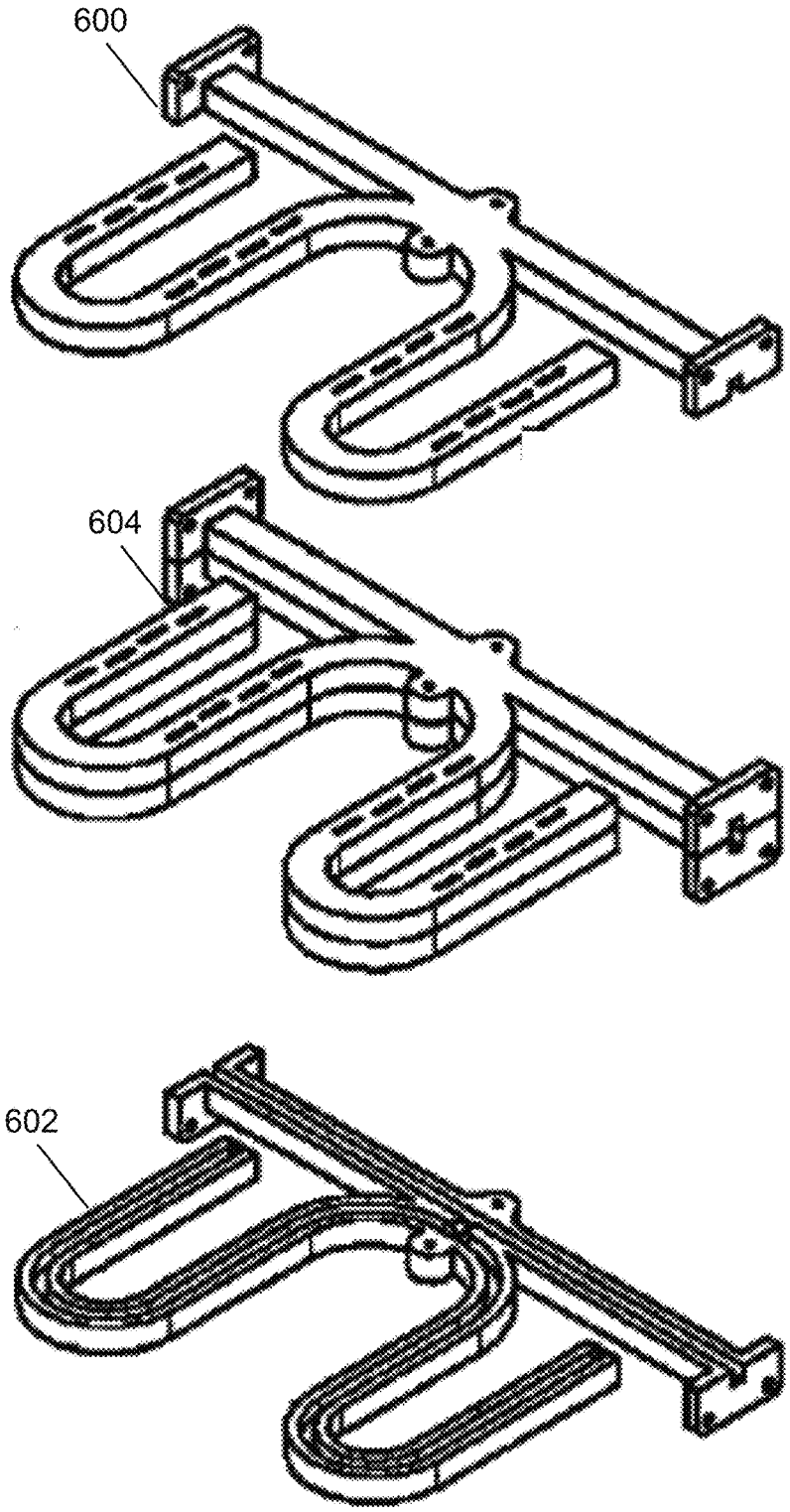
FIG. 6 depicts different top perspective views of an example waveguide network with slotted hole waveguide in accordance with embodiments of the present disclosure.

Example advantages of digitally prototyped waveguides are twofold: the ability to create a complicated network in one piece and the possibility of fabricating integrated waveguide circuits. FIG. 6 shows an example waveguide network that can be made in accordance with the present disclosed subject matter. Referring to FIG. 6, the network features a direction coupler, and two slotted waveguides. The network can be assembled from an upper half 600 and a lower half 602 specifically designed for this network. The middle part of the figure shows the assembled waveguide 604. The upper half 600 and the lower half 602 assembled together forms a slotted waveguide section and coupling hole as shown. Such a waveguide can be used to construct a distributed antenna with fewer components than a typical method of assembling individual waveguides and slotted antennas. Not only are all the components fabricated simultaneously and precisely together, but the losses of interfacing separate components are avoided.

Figure 7:
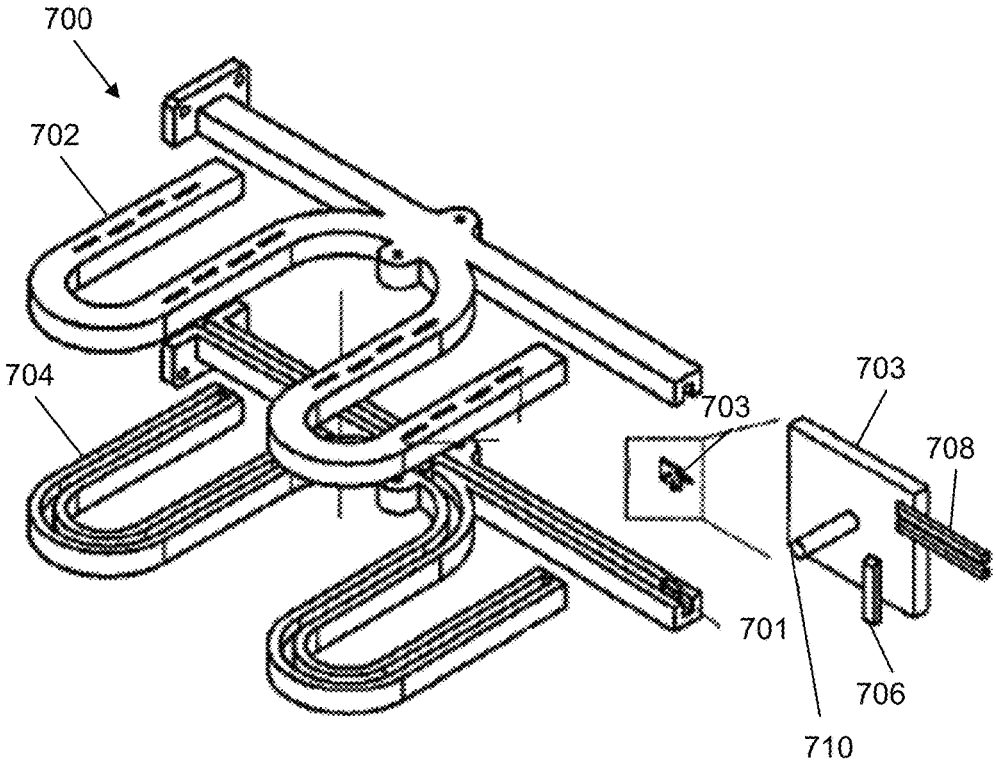
FIG. 7 is an exploded view of an example waveguide network designed for chip integration in accordance with embodiments of the present disclosure.

FIG. 7 shows an integrated waveguide network 700 similar to the one shown in FIG. 6 but with a slot 701 for a monolithic microwave integrated circuit (MMIC) chip 703 (also shown in magnified view) that takes feeds from other components and couples the output radiation into a waveguide. The waveguide network 700 includes an upper half 702 and a lower half 704. Also, the waveguide network 700 is shown in an exploded view for ease of understanding. A pedestal, stand, or slot 701 may be fabricated into the waveguide on which the MMIC is placed. Wire bonds or other conductors allow external connections to the MMIC 703 for power, intermediate frequency signals, configuration or tuning signals, or other MMIC pins. For example, the MMIC 703 includes a ground pin 706, an input pin 708, and an output coupling pin 710. An antenna on the MMIC 703 is designed for coupling to or from the waveguide in which it is placed. Alternatively, an external circuit board containing the MMIC 703 may be inserted through a slot in the wall of the waveguide, or the MMIC circuit board may be sandwiched between the upper and lower halves during assembly. Therefore, this prototyping technology can be well suited for integrating MMICs into the networks of waveguides, couplers, and antennas needed for radar and communications networks.

Figure 8:
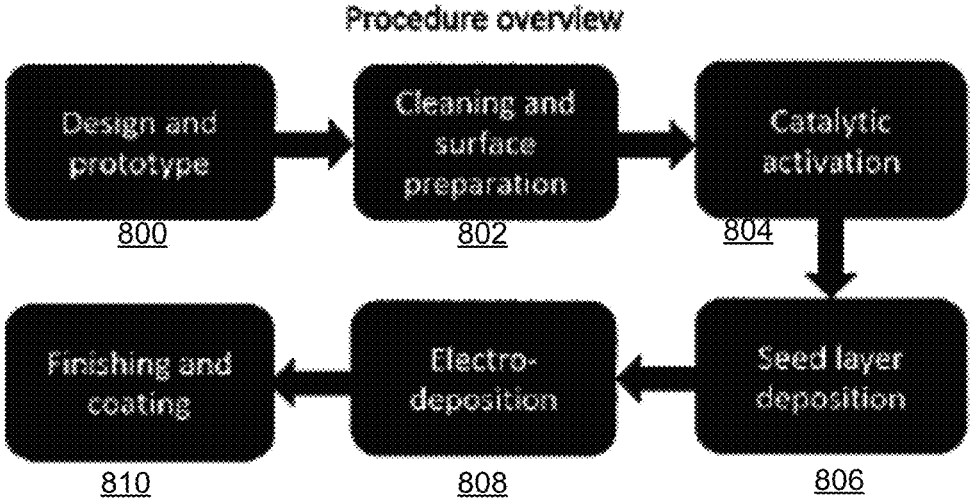
FIG. 8 is a flow chart an example method of the fabrication process in accordance with embodiments of the present disclosure.

FIG. 8 illustrates a flow chart an example method or procedure overview of the fabrication process in accordance with embodiments of the present disclosure. It is noted that any other suitable techniques and substitute steps may be used in the alternative. Referring to FIG. 8, the design may, in an initial step 800, be modeled by computer-aided design (CAD) software such as AUTODESK INVENTOR®, SOLIDWORKS®, or any other suitable software. The model may subsequently be 3D printed in plastic material. The 3D printer can be a type that can achieve resolution up to 16 microns, or another suitable resolution for high precision modeling for a high frequency waveguide. The waveguides can feature split block designs so that electro-deposition can be achieved. Digital prototyping can allow features that are difficult to make with traditional machining and pressing, especially in large quantities. One example of such a feature is the aforementioned lip that creates the wiping action for perfect sealing of split blocks, as shown in FIG. 2. Although 3D printing it a very efficient way of prototyping a plastic waveguide, casting plastic waveguides with metal mold is also an efficient technique if large numbers of identical waveguide pieces are needed.

Figure 9:
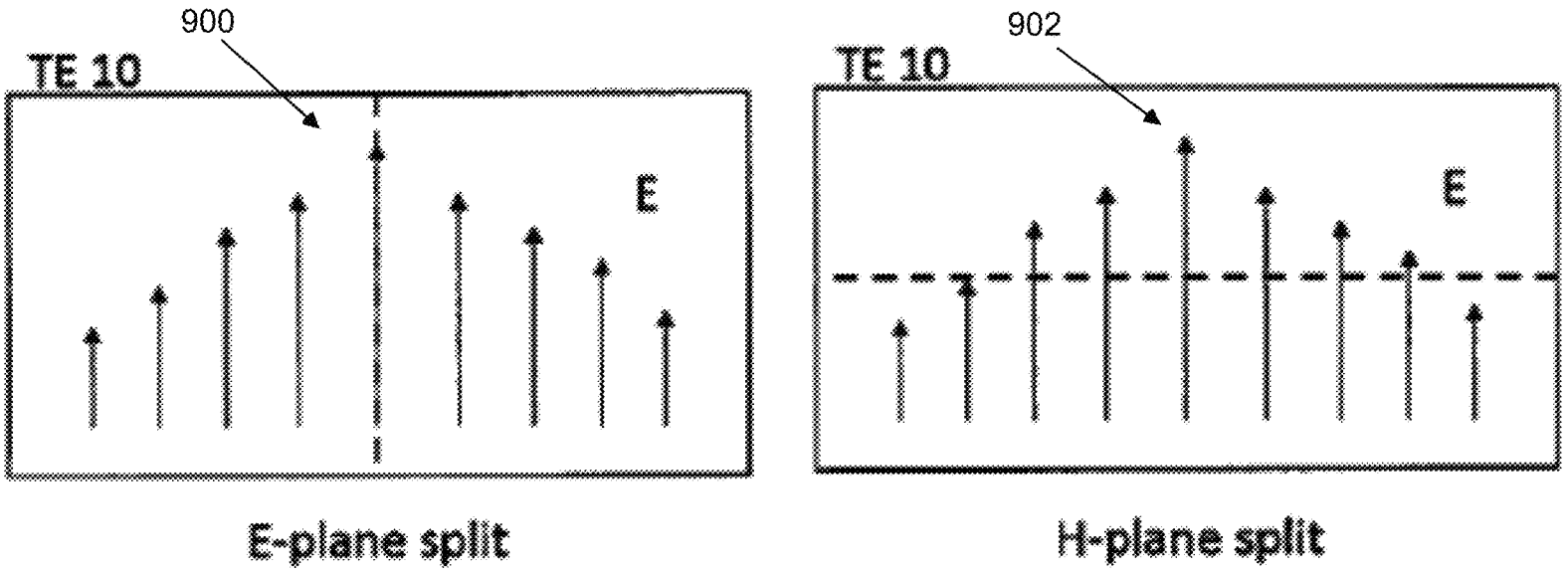
FIG. 9 depicts diagrams of the E-field of TE10 mode in a rectangular waveguide and split configurations.

To facilitate later electrodeposition, the microwave components are usually designed in split block configurations. This is because splitting a component into two pieces from the center plane of the channel exposes the interior of the channel which facilitates metallization of the channel. It is possible to create a microwave component as one unbroken piece, however electrodeposition inside the channel can be difficult. Splitting the component can be done in two different ways, E-plane splitting and H-plane splitting. For a TE10waveguide section as shown in FIG. 9, the E-field distribution 900, shown in the left graph, is perpendicular to the broad wall. The more efficient way of splitting the channel is the E-plane split which leaves the crack in the less sensitive plane. H-plane split 902, shown in the right graph, is also feasible, however it needs perfect alignment and polishing of the surface.

With continuing reference to FIG. 8, the surface of the part may be cleaned using a degreaser such as trisodium phosphate. As created by the 3D printer, the plastic waveguide surface may be covered with grease which can prevent deposition of the catalyst and conductive metal. Trisodium phosphate may be used because the grease can be removed in a strong basic environment and trisodium phosphate can also dissolve residual support material. Other degreasers or cleaners may be used to prepare the surface such as sodium hydroxide.

After the grease and residual support material are cleaned, the surface is oxidized using sodium percarbonate (step 804) as a catalytic activation. Oxidation may be needed because the plastic surface is hydrophobic. The surface energy can be lowered to enable surface wetting which may be needed to deposit other material. The waveguide can be treated in sodium percarbonate solution for 10 minutes at 50 degrees Celsius (C) to 60 degrees C. The strong oxidation by sodium percarbonate can also create micro-pores on the surface which increases the total surface area. Other oxidizers that may be used are ammonium persulfate, sodium persulfate, peracetic acid, hydrogen peroxide, or chromic acid etching.

Regarding seed layer deposition 806 in FIG. 8, the part being plated acts as the cathode during electro-deposition 808, thus requiring a surface deposited with metal such as copper, nickel, gold, or other suitable materials. One example technique is to deposit copper onto the plastic waveguide with electroless deposition. Copper ions are reduced to copper metal in the electroless deposition reactions.

Electroless deposition is essentially a redox reaction described by the following equation:

$$M_{solution}^{2+} + Red_{solution} \xrightarrow{\text{catalytic surface}} M_{latic} + OX_{solution}.$$

The catalytic surface can be the substrate itself, or non-catalytic substrate with catalytic substance deposited on the surface. In an example, the substrate may be plastic, thus the effective solution is to deposit a layer of catalytic substance on the surface. Example catalysts include silver and palladium. The deposition of silver can be done by reducing Ag(I) to Ag(0) by Sn(II) oxidation to Sn(IV) through the following reaction:

$$Sn^{2+}+2Cl^{-}+2Ag^{+}+2NO_3^{-} \rightarrow Sn^{4+}+2Ag^{0}+2Cl^{-}+2NO_3^{-}.$$

The chloride ions can either be supplied by hydrochloric acid or stannous chloride. The part is treated in silver nitrate solution and stannous chloride solution alternatively, and repeated until the plastic waveguide is fully covered in solver, which appears as a brown, gray, or black stain in its colloidal form.

The waveguide may then be ready for the electroless copper deposition. Formaldehyde (HCHO) can be used as the reducing agent in the following reaction that dictates the electroless copper deposition:

$$Cu^{2+}+2HCHO+4OH^{-} \rightarrow Cu+2HCOO^{-}+2H_2O+H_2.$$

Formaldehyde can only act as a reducing agent when in an alkaline environment, i.e. a pH 12 of above. Howver, copper ions form copper hydroxide and tend to precipitate out of the solution. A chelator such as EDTA or triethanolamine (TEA) can be used to prevent copper hydroxide precipitation. The concentrations of reactants and temperature are two important factors that control the rate of reaction. Electroless plating reaction heats up the solution, and is also an autocatalytic reaction, i.e. deposited copper catalyzes the oxidation of formaldehyde and the reduction of copper. The reaction condition and reactant concentration should thus be carefully controlled.

The part can be treated with a solution that contains 5 g/L copper sulfate, 10 g/L ETA, 5 g/L sodium hydroxide, and 20 mL/L 4% formaldehyde as reactant, and 100 mL/L triethanolamine as chelator and pH buffer. The temperature should be maintained at 50-60 degrees C., and pH be maintained between 12 to 12.5. Successful electroless copper plating is able to deposit copper of a few microns, which is enough to act as a seed layer for electroplating.

Regarding electro-deposition in the method of FIG. 8, acidic electroplating may be employed to deposit copper onto the electroless plated seed layer. Acidic solution reduces the voltages required for depositing copper because of less polarizations between the anode and cathode. An example technique may use sulfuric acid, and fluoboric acid. Weaker acid such as acetic acid can also be used in the case when less hazardous chemical are used, however sacrificing the throwing power of the plating solution. Additives can be introduced to the plating solution to brighten, harden, and smooth the deposition. General plating processes and types of additives that can be used should be understood by those of skill in the art.

In experiments, the plating solution included 43 mL/L Acetic acid, 120 g/L copper sulfate, 98 g/L citric acid. Additives include 0.132 g/L sodium chloride, 0.5 g PEG (polyethylene glycol), 0.06 g sodium MPSA (3-mercapto 1-propanesulfonate), 0.06 g Janus Gren B.

One example factor of electro-deposition is the agitation of the plating solution. Types of agitation include ultrasonic agitation, air agitation, reciprocating paddle agitation, and the like. Agitation can ensure uniform deposition of copper onto the piece. In addition, agitation needs to be balanced with current density, i.e. a strong agitation pairs with low current density, and a weak agitation requires high current density.

Regarding finishing and coating 810 in FIG. 8, the finished part can be immediately transferred into a container filled with benzotriazole solution. Benzotriazole is a corrosion inhibitor for copper by preventing surface reactions. A passive layer can be formed on top of the copper surface when the part is drenched in benzotriazole solution. To further protect the copper surface, the part may be treated with a diluted acrylic latex suspension solution.

Figure 10:
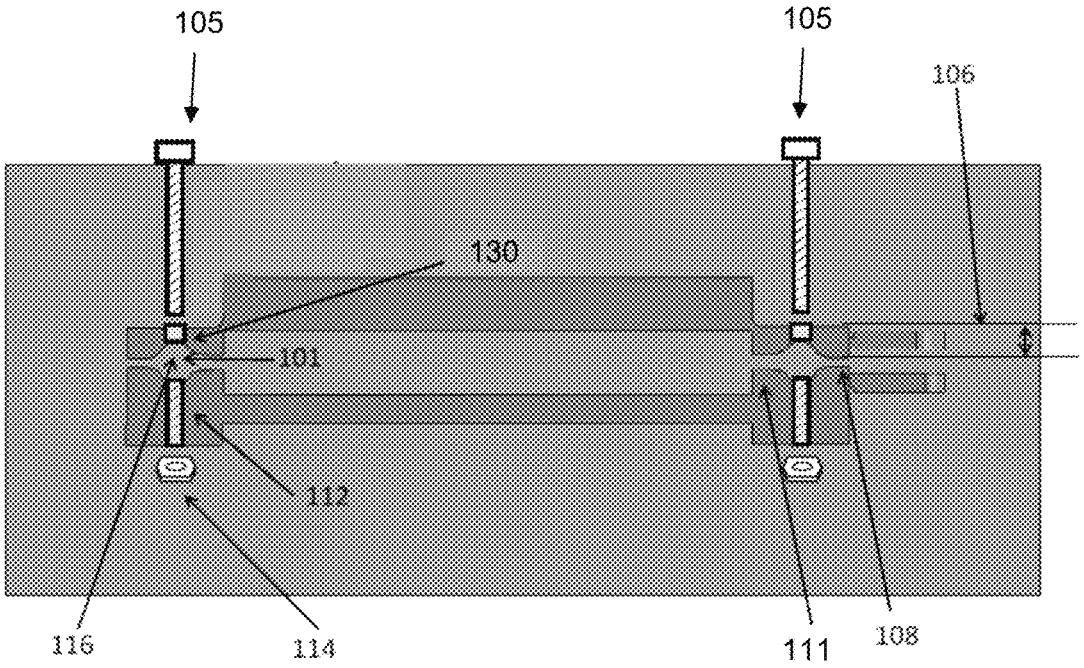
FIG. 10 illustrates an example of the gasket-free electromagnetic seal in accordance with the illustrative embodiment of the present disclosure.

FIG. 10 illustrates an example of the gasket-free electromagnetic seal in accordance with the illustrative embodiment of the present disclosure. As shown in FIG. 10, a top surface and bottom part that form a cavity 101 in which electromagnetic radiation resonates, so that losses, including those from the edge of the cavity 101, decrease the quality factor of the resonance. Still referring to FIG. 10, a U shaped gap 116 forms a spring force by an inner edge 111 and outer edge 108. At the top of the U shaped gap 116, there are through holes 130 to insert screws 105, and at the bottom part of the surface, there is a nut 114 and tapped or through holes 112 to secure the screws 105. The nut 114 may also be used to prevent the screw 105 from stripping the threads on the plastic. Inserting the screw 105 into the through hole 112 and into the bottom part of the surface provides the force to compress the gap 116 spring. The outer edges 108 of the bottom and top parts of the surface are slightly closer than the inner edges 111, so the outer edges 108 touch before the inner edges 111 as the gap 116 is compressed. The outer edges 108 are curved gently towards the inner edges 111, so that the surface area of contact starts at the outside perimeter of the outer edges 108 away from the inner edges 111, with the surface in contact growing towards the inner edges 111 with increasing pressure between the top and bottom parts of the surface. In an example, it is noted that the gasket-free electromagnetic seal shown in FIG. 10 may be modified to include a conductive gasket positioned between the first and second component such that it includes a gasket.

With continuing reference to FIG. 10, the inner edges 111 are gently curved towards the outer edges 108, so that when the inner edges 111 comes into contact with increasing compression of the gap 116, the inner perimeter of the inner edges 111 is contacted first. As one would skill in the art would appreciate, increasing the pressure on the gap 116 further grows the surface area of contact of the inner edges 111 towards the outer edge 108. Because the space between the outer edges 108 is narrower than the space between the inner edges 111, the contact point on the outer edges 108 acts as a pivot to redirect the force compressing the gap 116 onto the inner edge111. If the two spaces were nearly equal, or if the space between the inner edges 111 was larger than the outer edges 108, it would be uncertain which of the inner or outer edges would be increasingly closed as pressure is applied to the gap 116 spring. To ensure that the seal deforms and not the electromagnetic cavity 101, the outside of the top part of the surface is thinned to deform and seal to the bottom, but the plastic thickness above the cavity 101 is retained. There are also two tabs on the side used as the connection for electroplating electrodes that are not needed for the seal, but are useful to ensure that the electroplating process does not damage the metal coating, as the quality of the coating in the immediate neighborhood of the cathode is usually lower quality.

Figure 11:
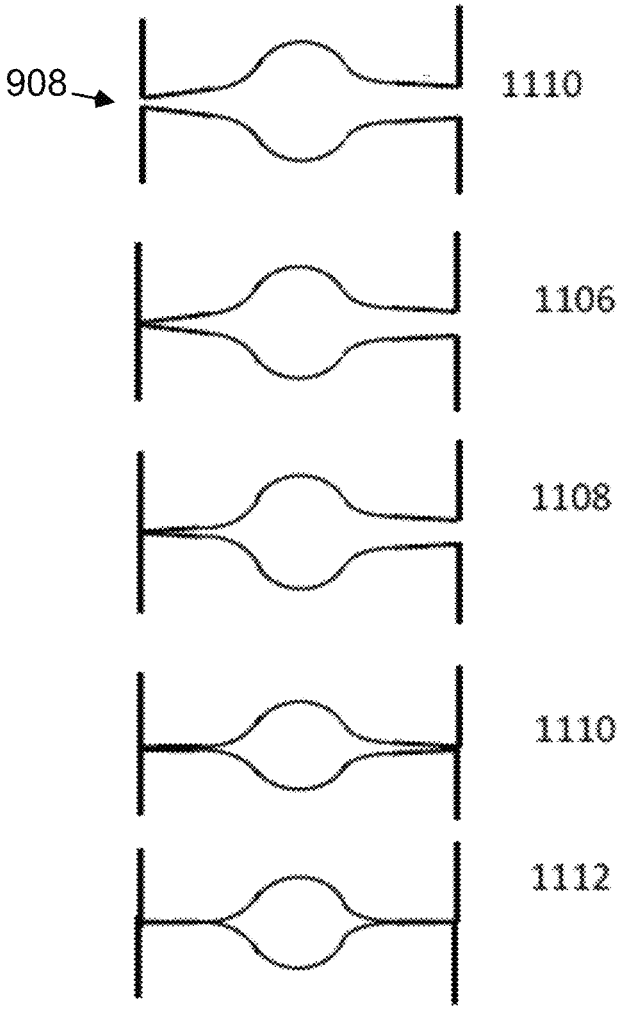
FIG. 11 depicts the steps for surface contact, as well as deformations occurring to form a seal, as pressure is increased between the top and bottom surfaces in accordance with the illustrative embodiment of the present disclosure.

FIG. 11 depicts the steps for surface contact, as well as deformations occurring to form a seal, as pressure is increased between the top and bottom surfaces in accordance with the illustrative embodiment of the present disclosure. At step 1106, the outer corner of the outer edge 908 comes into contact first. With increased pressure, the surfaces push against each other and at step 1108, the surfaces pushed against each other are flatten and deform the plastic. With further applied pressure, the inner edge 1010 comes into contact at step 1110. As the outer edge 908 is already compressed, at step 1112, the applied force is shifted to the inner edge 1008. Also at step 1112, the outer edge 908 acts as a pivot or hinge which directs the further force onto the inner edge, closing it from the inside outside. As the contact area on the inner edge 1010 increases, the air is pushed out of the space between the upper and lower inner edges of the inner edge 1010, outer edge 908 and the conductive surfaces of the inner edge 1010 form a tight seal.

Figure 12:
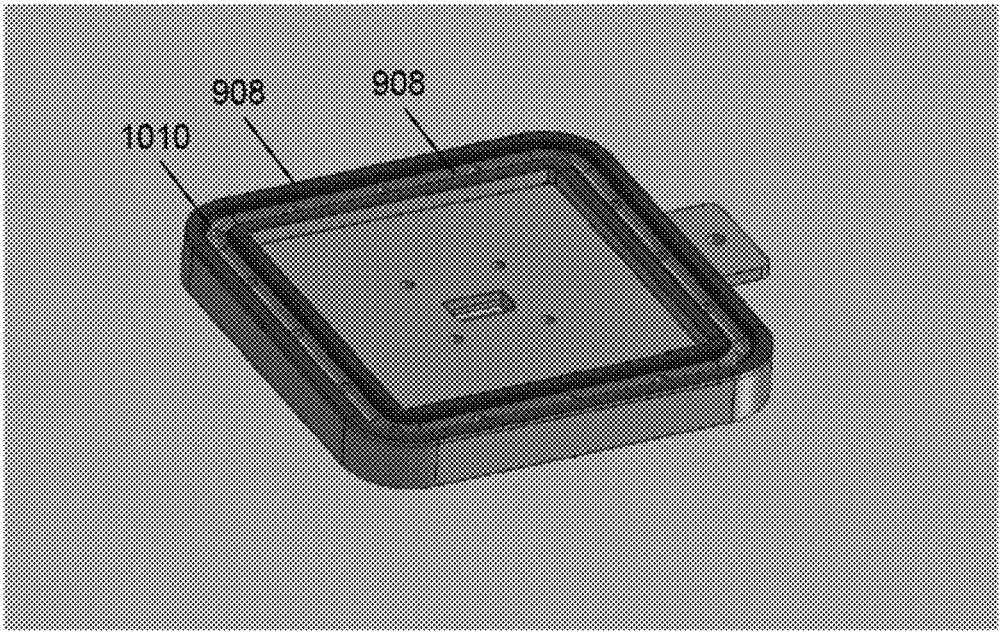
FIG. 12 illustrates a top view of the mating surface of the cavity.
Figure 13:
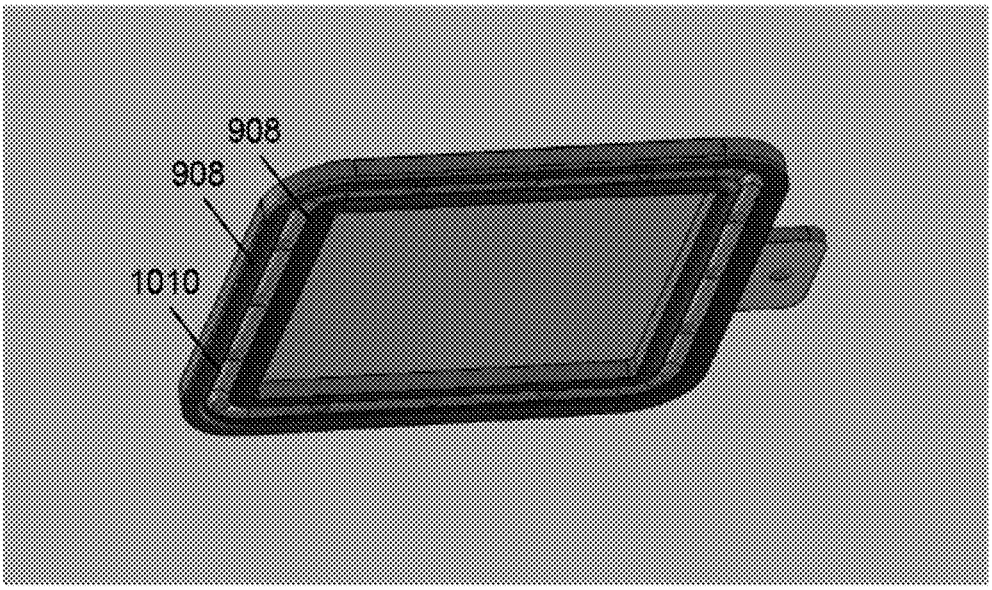
FIG. 13 illustrates another top view of the mating surface of the cavity where the screws apply pressure around the entire perimeter of the cavity.

FIG. 12 illustrates a top view of the mating surface of the cavity. As shown in FIG. 12, the inner edge 1010 and outer edge 908 surround the cavity volume. FIG. 12 depicts a top-bottom visualization of the mating surface of the cavity. FIG. 13 further illustrates another view showing the inner edge 1010 and outer edge 908, and where the screws apply pressure around the entire perimeter of the cavity.

Figure 14:
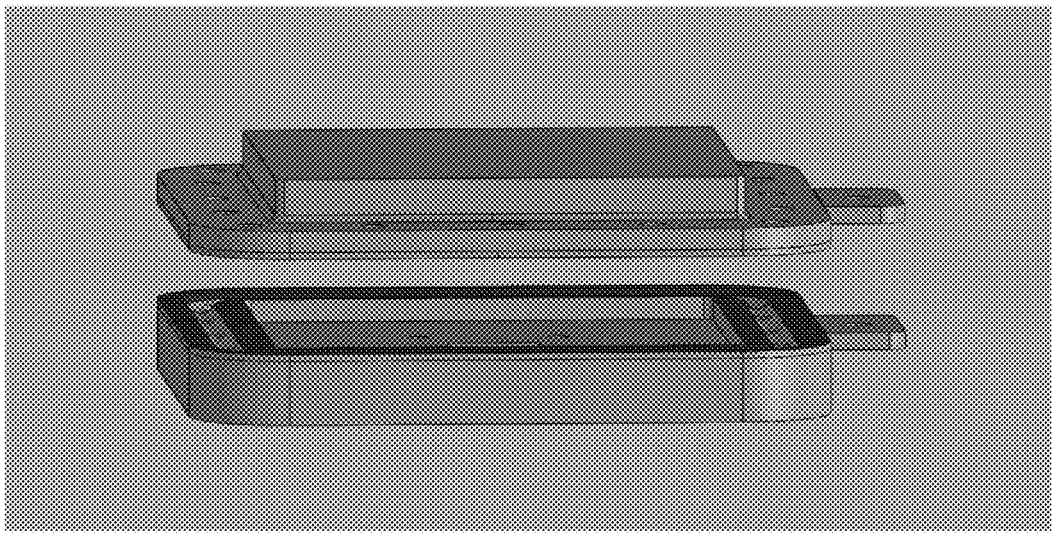
FIG. 14 illustrates a side view of the top and bottom portions of the cavity, with the top of the perimeter thinned to allow for deformation of the top edges to meet the bottom edges.

FIG. 14 illustrates the top and bottom portions of the cavity, with the top of the perimeter thinned to allow for deformation of the top edges to meet the bottom edges.

Figure 15:
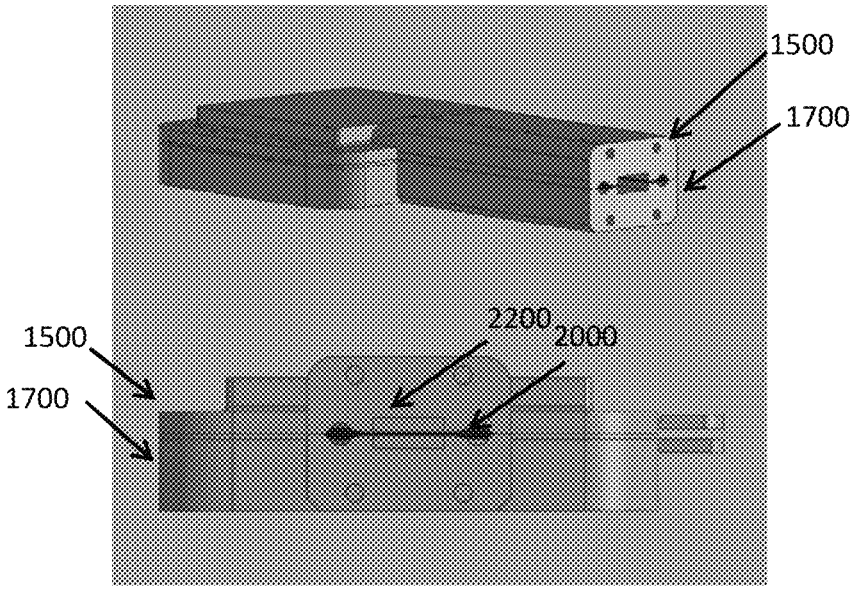
FIG. 15 is a side view of a waveguide section and a cavity section joined by a seal.

FIG. 15 illustrates two components, a waveguide section 1500 and a cavity section 1700 are joined by a seal 2000. The seal is continuous around both components to ensure there is no losses at a joint between the two sections. There are screw holes through the seal 2000 that enable pressure to be applied to the seal 2000 by inserting and tightening screws, but the screws are not shown. The seal 2000 at the end of the waveguide forms a rectangular waveguide channel 2200. By arranging the correct hole pattern around the waveguide channel, a standard waveguide adapter may be attached to the channel An advantage of the present invention is that it allows for a continuous seal 2000 between different components such as the waveguide and cavity section shown here, and does not require for these components to be manufactured separately and joined later. Furthermore, the seal 2000 allows the upper and lower half to be manufactured and electroplated separately, as planar components are much easier to electroplate than already assembled waveguide tubes and cavities.

Figure 16:
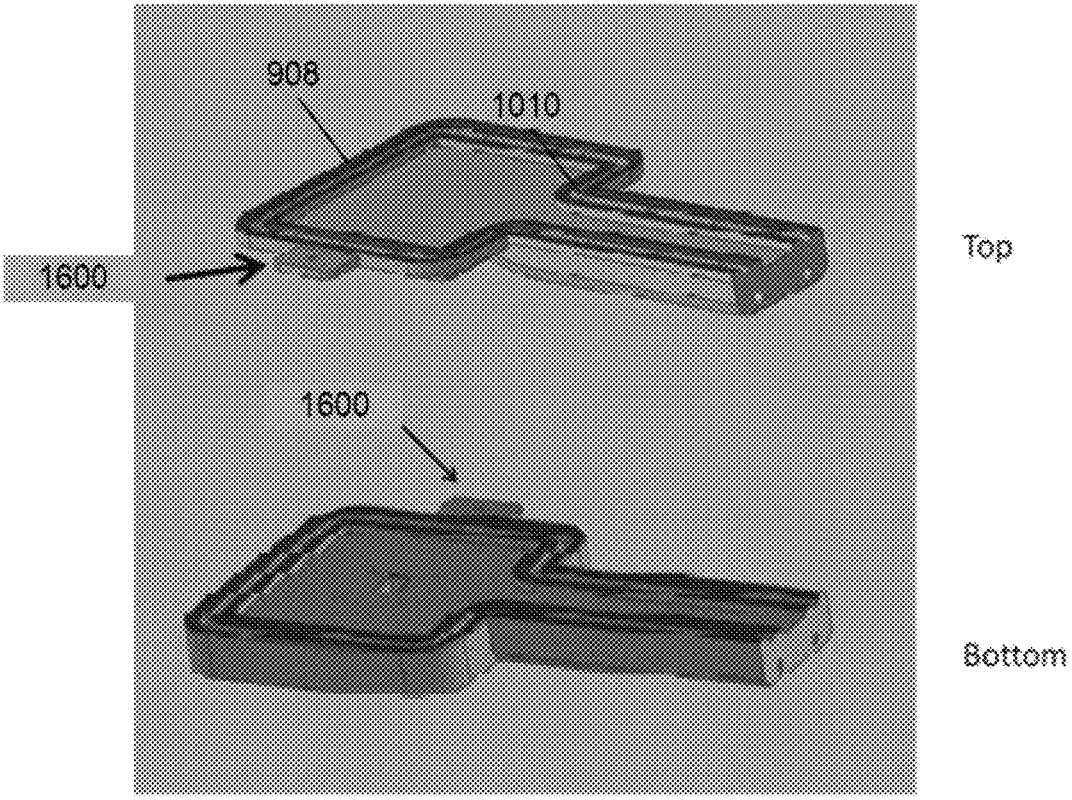
FIG. 16 illustrates a top and bottom of the cavity separately, with the double-contact seal around the boundary of both the top and bottom.

FIG. 16 illustrates the top and bottom of the cavity separately, with the double-contact seal around the boundary of both the top and bottom. The bottom is tapped for the screws, and the top is through-hole. There is also a waveguide adapter on the bottom of the cavity, showing a second waveguide flange. Tabs 1600 on the side of the top and bottom cavities are used to attach the electroplating cathode connection, and may be removed after electroplating is completed. The outer edge 908 and the inner edge 1010 are shown.

Figure 17A:
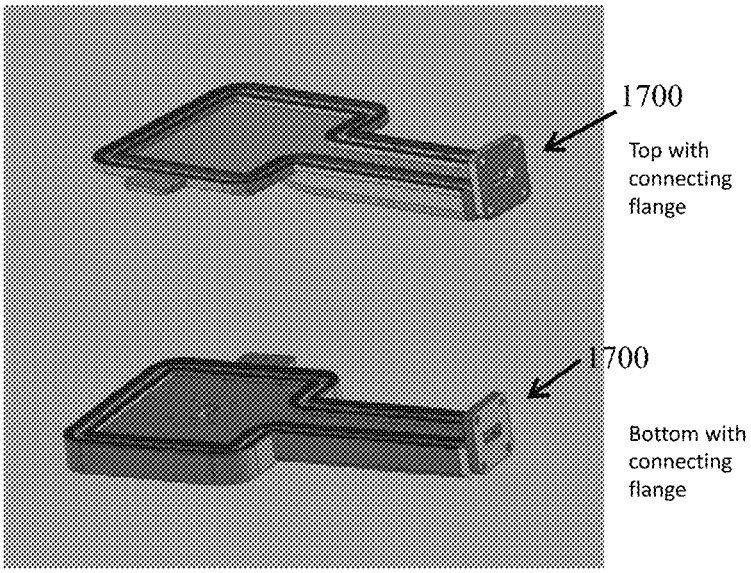
FIG. 17A is a top perspective view of a top and bottom cavity with an example flange that would attach to the end of the waveguide.

FIG. 17A illustrates the top and bottom cavity with an example flange 1700 that would attach to the end of the waveguide. In an alternate embodiment, the flange 1700 could be another waveguide section or a waveguide to coaxial cable adapter, for example. It would likely be chosen as a standard waveguide flange size, such as WR42 for K-band frequencies, and WR10 for W-band frequencies.

Figure 17B:
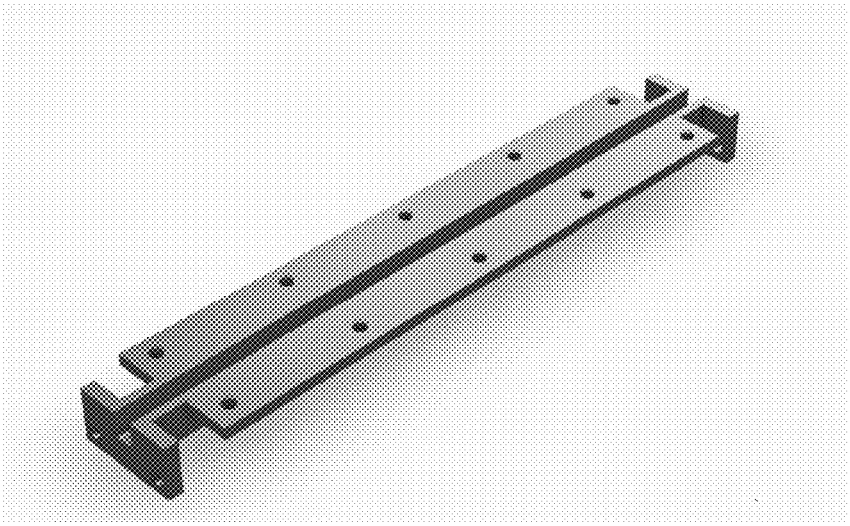
FIG. 17B is a top perspective view of another example lower part of a waveguide in accordance with embodiments of the present disclosure.

FIG. 17B is a perspective view of another example lower part of a waveguide in accordance with embodiments of the present disclosure.

Figure 18:
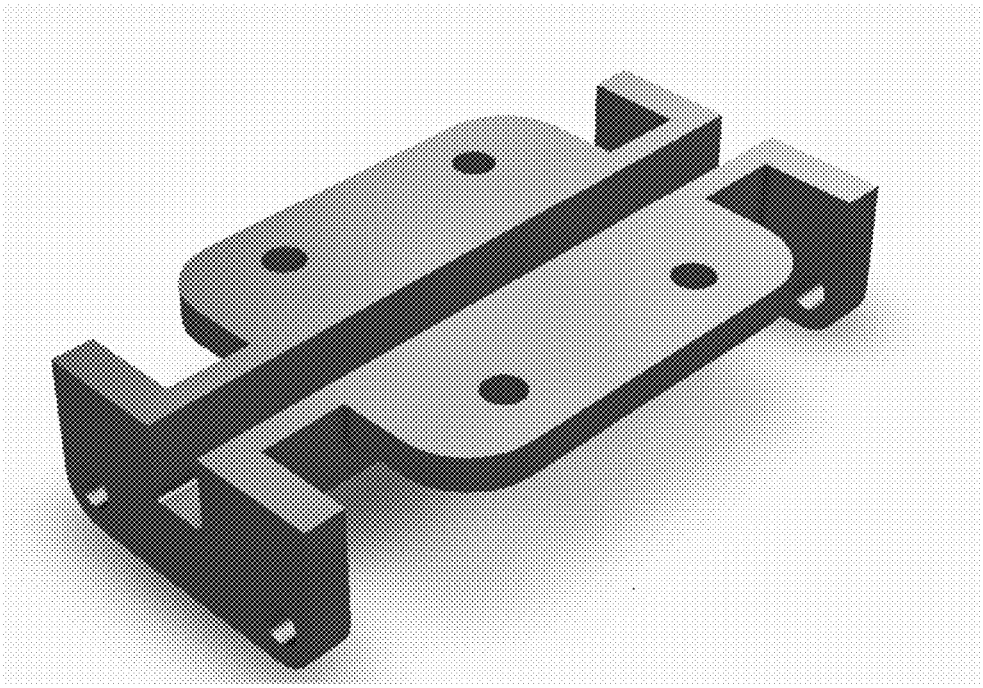
FIG. 18 is a top perspective view of another example lower part of a waveguide in accordance with embodiments of the present disclosure.

FIG. 18 is a perspective view of another example lower part of a waveguide in accordance with embodiments of the present disclosure.

Figure 19:
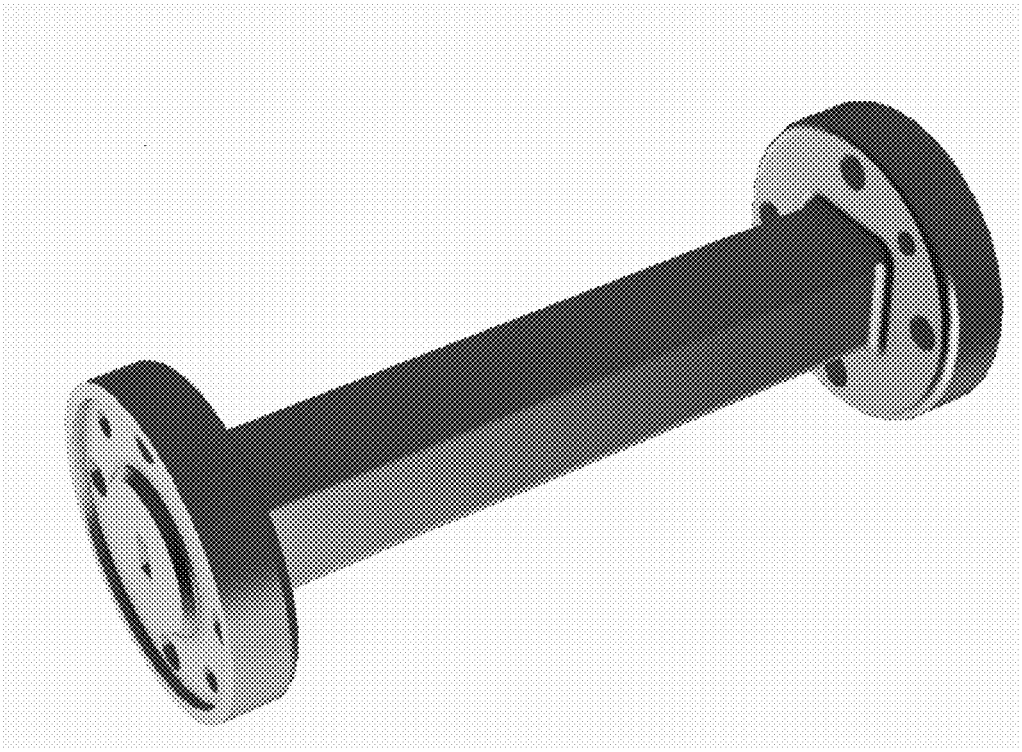
FIG. 19 is a top perspective view of another example of an assembled waveguide in accordance with embodiments of the present disclosure.

FIG. 19 is a perspective view of another example of an assembled waveguide in accordance with embodiments of the present disclosure.

Figure 20:
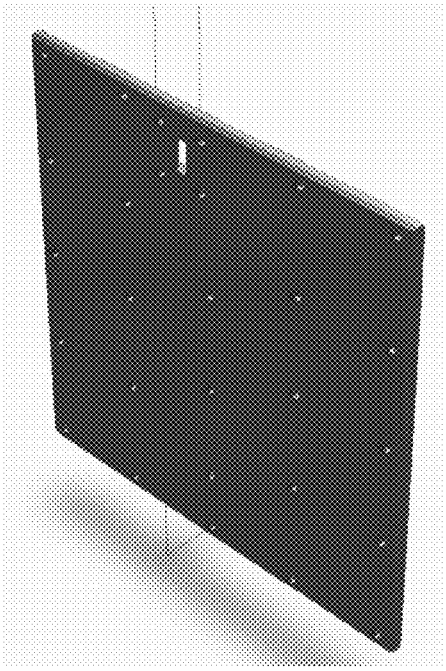
FIG. 20 is a side perspective view of an example waveguide component in accordance with embodiments of the present disclosure.

FIG. 20 is a side perspective view of an example waveguide component in accordance with embodiments of the present disclosure.

FIG. 21 is a side perspective view of an example spiral waveguide component in accordance with embodiments of the present disclosure.

FIG. 22 is a top perspective view of an example waveguide component in accordance with embodiments of the present disclosure.

Figure 23:
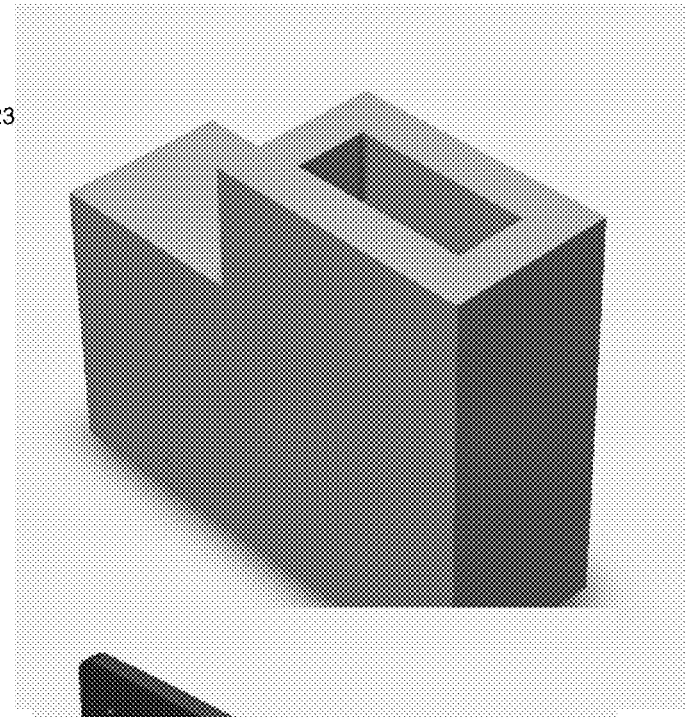
FIG. 23 is a top perspective view of an example waveguide component in accordance with embodiments of the present disclosure.

FIG. 23 is a top perspective view of an example waveguide component in accordance with embodiments of the present disclosure.

Figure 24:
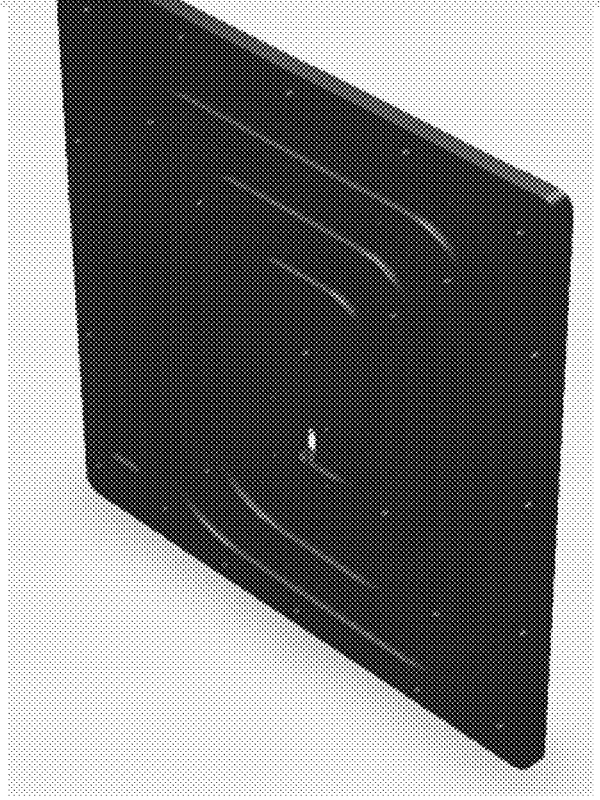
FIG. 24 is a side perspective view of an example spiral waveguide component in accordance with embodiments of the present disclosure.

FIG. 24 is a side perspective view of an example spiral waveguide component in accordance with embodiments of the present disclosure.

Figure 25:
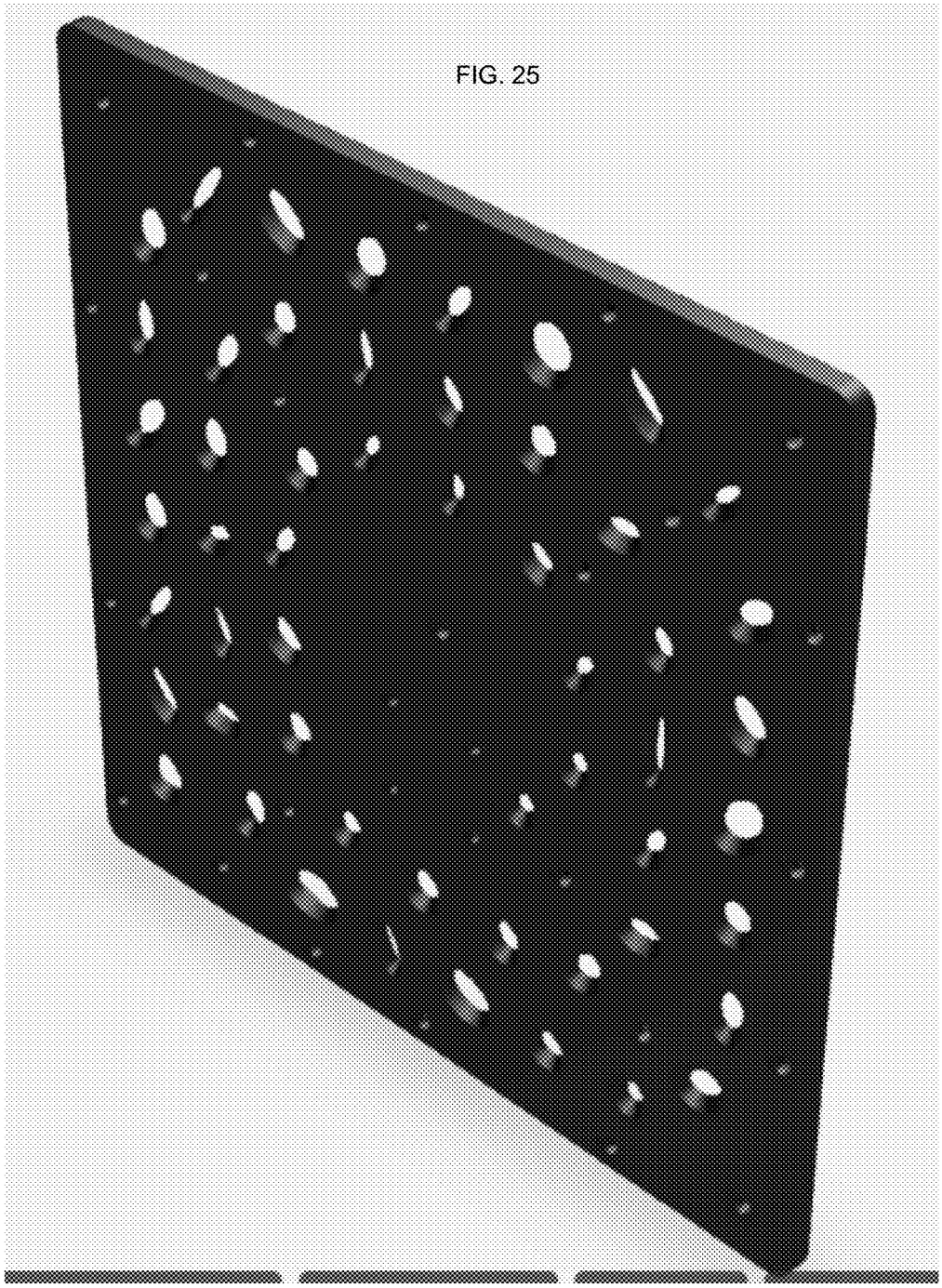
FIG. 25 is a side perspective view of an example waveguide component in accordance with embodiments of the present disclosure.

FIG. 25 is a side perspective view of an example waveguide component in accordance with embodiments of the present disclosure.

Figure 26:
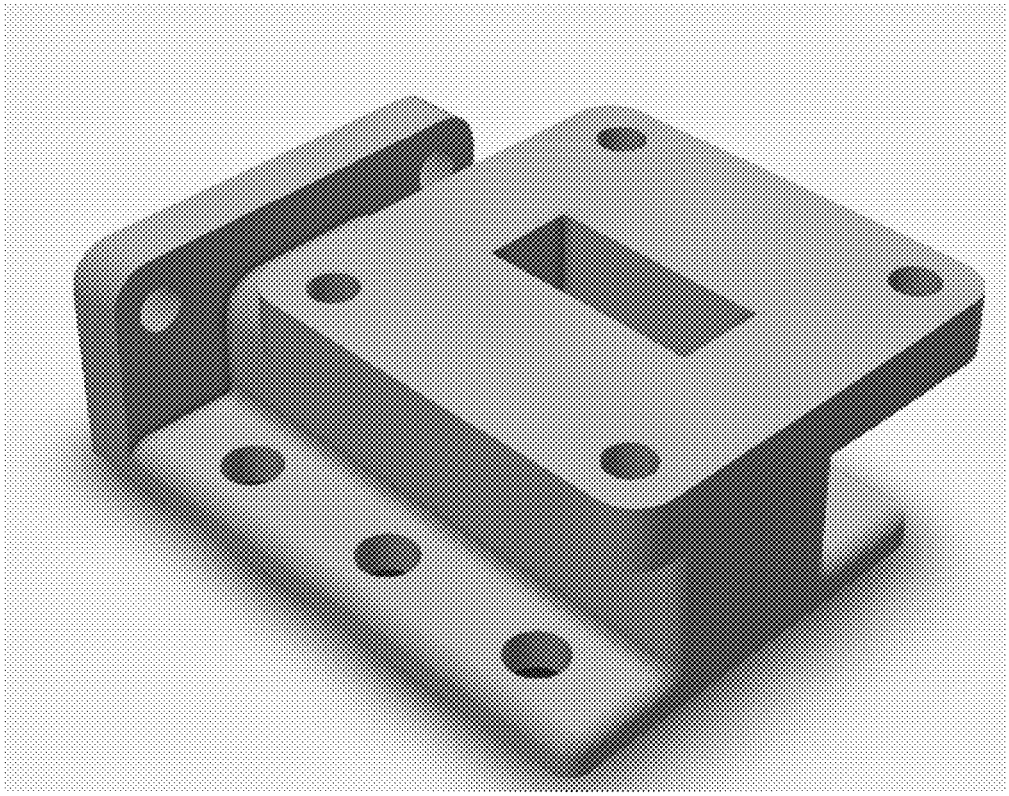
FIG. 26 is a top perspective view of an example waveguide component in accordance with embodiments of the present disclosure.

FIG. 26 is a top perspective view of an example waveguide component in accordance with embodiments of the present disclosure.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A waveguide comprising:

a body comprising first and second components that are attachable together to form an interior having a first surface, wherein the first surface extends in a substantially linear direction within the body, wherein the first component defines a second surface with an extruding lip, wherein the second component defines a third surface with an intruding groove; and wherein the extruding lip and the intruding groove fit together when the first and second components are attached and wipe against each other during attachment to form an air-free junction between the second surface and the third surface during attachment of the first and second components; and a conductive material formed on the first surface and shaped to convey electromagnetic waves.

2. The waveguide of claim 1, wherein the first and second components each comprise plastic.

3. The waveguide of claim 1, wherein the first component and the second component define at least two openings that lead to the interior of the body.

4. The waveguide of claim 1, wherein the conductive material comprises metal.

5. The waveguide of claim 1, wherein the first surface defines at least one curved section.

6. A waveguide comprising:

a body comprising first and second components that are attachable together to form an interior having a first surface, wherein the first component and the second component are soldered together, wherein the first component defines a second surface with an extruding lip, wherein the second component defines a third surface with an intruding groove; and wherein the extruding lip and the intruding groove fit together when the first and second components are attached and wipe against each other during attachment to form an air-free junction between the second surface and the third surface during attachment of the first and second components; and a conductive material formed on the first surface and shaped to convey electromagnetic waves.

7. A waveguide comprising:

a body comprising first and second components that are attachable together to form an interior having a first surface, wherein the first and second components are three-dimensional (3D) printed components, wherein the first component defines a second surface with an extruding lip, wherein the second component defines a third surface with an intruding groove; and wherein the extruding lip and the intruding groove fit together when the first and second components are attached and wipe against each other during attachment to form an air-free junction between the second surface and the third surface during attachment of the first and second components; and a conductive material formed on the first surface and shaped to convey electromagnetic waves.

* * * * *